United States Patent [19]

Morse

[11] Patent Number: 4,627,247

[45] Date of Patent: Dec. 9, 1986

[54] SUCTION ACCUMULATOR

[75] Inventor: Robert L. Morse, Adrian, Mich.

[73] Assignee: Tecumseh Products Company, Tecumseh, Mich.

[21] Appl. No.: 842,311

[22] Filed: Mar. 21, 1986

[51] Int. Cl.[4] ..... F25B 43/00

[52] U.S. Cl. ..... 62/503; 55/192

[58] Field of Search ..... 62/503; 55/189, 192

[56] References Cited

U.S. PATENT DOCUMENTS

| | | | |
|---|---|---|---|
| 421,017 | 2/1890 | Stein | 55/423 |
| 796,429 | 8/1905 | Huxley | 55/413 |
| 1,746,406 | 2/1930 | Sawyer | 62/204 |
| 1,978,463 | 10/1934 | Kettering | 62/115 |
| 2,402,845 | 6/1946 | Rodman | 183/106 |
| 3,084,523 | 4/1963 | Bottum et al. | 62/296 |
| 3,163,998 | 1/1965 | Wile et al. | 62/278 |
| 3,283,524 | 11/1966 | Byron | 62/115 |
| 3,370,440 | 2/1968 | Kellie | 62/503 |
| 3,429,139 | 2/1969 | Wile et al. | 62/278 |
| 3,563,053 | 2/1971 | Bottum | 62/503 |
| 3,643,465 | 2/1972 | Bottum | 62/503 |
| 3,698,207 | 10/1972 | Melnyk | 62/503 |
| 3,837,177 | 9/1974 | Rockwell et al. | 62/503 |
| 3,872,689 | 3/1975 | Bottum | 62/503 |
| 4,009,596 | 3/1977 | Morse | 62/503 |
| 4,111,005 | 9/1978 | Livesay | 62/503 |
| 4,182,136 | 1/1980 | Morse | 62/503 |
| 4,187,088 | 2/1980 | Hodgson | 55/169 |
| 4,194,370 | 3/1980 | Morse | 62/503 |
| 4,194,371 | 3/1980 | Morse | 62/503 |
| 4,199,960 | 4/1980 | Adams et al. | 62/503 |
| 4,208,887 | 6/1980 | Morse et al. | 62/503 |
| 4,270,934 | 6/1981 | Widdowson et al. | 55/316 |
| 4,276,756 | 7/1981 | Livesay | 62/503 |
| 4,291,548 | 9/1981 | Livesay | 62/503 |
| 4,354,362 | 10/1982 | Schumacher et al. | 62/474 |
| 4,401,447 | 8/1983 | Huber | 55/387 |
| 4,474,035 | 10/1984 | Amin et al. | 62/503 |

*Primary Examiner*—Ronald C. Capossela

*Attorney, Agent, or Firm*—Jeffers, Irish & Hoffman

[57] ABSTRACT

A suction accumulator including a tubular housing defining a liquid storage vessel. A conduit is arranged in the vessel and includes a divider plate for forming two fluid flow passageways. A plastic transition cap is secured to one end of the conduit to form a connection passage between the two fluid flow passageways. A tubular conduit extends from the liquid storage volume through the transition cap member and into the upflow passageway whereby liquid refrigerant is aspirated from the liquid storage volume into the upflow passageway. A screen member is provided in the transition cap member to prevent impurities from flowing through the tubular conduit into the upflow passageway. In one embodiment, a pair of pressure equalizing vents are integrally molded with the conduit to equalize pressures in the accumulator when the compressor is turned off. In another embodiment, a pressure equalizing vent directly connects the outlet of the accumulator to the liquid storage vessel.

26 Claims, 14 Drawing Figures

SUCTION ACCUMULATOR

BACKGROUND OF THE INVENTION

The present invention relates to a suction accumulator for a refrigeration system for separating liquid refrigerant from gaseous refrigerant, for storing the liquid refrigerant and for providing a metered supply of liquid refrigerant to the suction line of a compressor. More specifically, the present invention relates to an improvement in suction accumulators wherein the efficiency of the suction accumulator is increased and the size of the suction accumulator is reduced for a given mass flow rate of refrigerant as compared to prior art suction accumulators. Furthermore, a suction accumulator is provided which is more economical to manufacture than prior art suction accumulators.

Closed loop refrigeration systems conventionally employ a refrigerant which is normally in the gaseous state wherein it may be compressed by means of a compressor. The refrigerant leaves the compressor at relatively high pressure and is then routed through a condenser coil and an evaporator coil back to the compressor for recompression. The refrigerant, after it leaves the evaporator, under some circumstances such as startup of the refrigeration system, may be in its liquid state. Also, during certain operating conditions of the refrigeration system, the evaporator will be flooded and excess liquid refrigerant could enter the suction line and return to the compressor. If liquid refrigerant enters the compressor suction inlet, "slugging" of the compressor may result whereby abnormally high pressures are generated in the compressor which in turn could cause blown gaskets, broken valves, etc.

Accordingly, prior art refrigeration systems have been provided with suction accumulators which act as storage reservoirs for liquid refrigerant which may be present in the suction line to prevent such liquid refrigerant from entering the compressor. Such accumulators permit the liquid refrigerant to change to its gaseous state before entering the compressor. A commonly used type of suction accumulator consists of a liquid storage vessel in which is received a generally U-shaped tube, one end of which is connected to the outlet of the storage vessel and the other end of which is open to the interior of the vessel. As the incoming liquid refrigerant flows into the vessel, it collects in the bottom thereof whereas the gaseous components are carried off through the U-shaped tube and the outlet of the vessel to the compressor suction inlet. Such suction accumulators may also include an orifice located in a bottom portion of the U-shaped tube whereby a small controlled amount of liquid refrigerant is metered into the stream of gaseous refrigerant which flows through the U-shaped tube. Such accumulators may furthermore provide for pressure equalization whereby the pressure at the outlet of the suction accumulator is equalized with the pressure in the liquid storage vessel to prevent higher pressures in the liquid from forcing liquid refrigerant into the suction inlet of the compressor when the compressor is turned off.

A problem with such prior art suction accumulators has been the difficulty in providing a small and compact suction accumulator having a large refrigerant mass flow rate. It is important to provide small suction accumulators, particularly in certain refrigeration systems wherein space is at a premium. Furthermore, it is important that suction accumulators be provided at a reasonable cost. Prior art suction accumulators have generally been made of steel, copper or aluminum parts which are assembled by soldering or brazing and which are therefore expensive both in terms of the cost of materials and labor.

Prior art suction accumulators of relatively small size have been provided, wherein the above-mentioned U-shaped tubes have been integrated into a single conduit including a divider weir or plate to divide the single conduit into two fluid flow passages. These structures have generally also been provided with a metering orifice immersed in the liquid refrigerant. While these types of accumulators represent an improvement over the prior art U-shaped tube type of accumulators, these accumulators have not been as effective as desired in providing a high mass refrigerant flow rate while providing an economical and compact design.

It is therefore desired to provide a compact suction accumulator having an effective liquid metering structure to provide a high refrigerant mass flow rate, while providing an economical design wherein a number of the parts may be molded or extruded from plastic material. It is furthermore desired to provide such an accumulator wherein an effective but simple pressure equalization structure is provided.

SUMMARY OF THE INVENTION

The present invention overcomes the disadvantages of the above-described prior art suction accumulators by providing an improved suction accumulator therefor.

The suction accumulator according to the present invention, in one form thereof, comprises a generally cylindrical casing including top and bottom end walls and forming a liquid storage vessel. An inlet is provided into the casing. A conduit is disposed inside the casing in a generally vertical direction, the conduit including upflow and downflow passageways. An outlet is connected to the upflow passageway whereas the upper end of the downflow passageway is open to the interior of the vessel. A cap member is secured to the lower end of the conduit to provide a connecting passage or transition zone for the gaseous refrigerant as it flows downwardly through the downflow passageway, through the connecting passage and upwardly into the upflow passageway. The cap member also includes a metering tube which extends from the liquid storage area of the vessel into the lower end of the upflow passageway. A low pressure zone is created by the venturi effect in the lower end of the upflow passage whereby liquid refrigerant will be drawn through the metering tube from the liquid storage reservoir into the upflow passageway.

The present invention, in one form thereof, further comprises a suction accumulator having an outer shell or casing and upper and lower end walls. An inlet and an outlet to the accumulator are provided in the upper end wall. The casing forms a vessel enclosing a storage volume. A generally vertically arranged conduit, which may be a plastic extrusion, is located in the vessel. The conduit is divided by a divider wall into two fluid flow passages comprising respectively an upflow passage and a downflow passage. The upflow passage is connected at its upper end to the outlet. The downflow passage is open at its upper end to the storage vessel. A plastic transition cap member is secured over the lower end of the conduit and forms a connecting passage for the upflow and downflow passages. A low pressure region is created in the lower end of the upflow passage. The transition cap member includes a fluid flow tube which extends from the lower end of the storage vessel into the lower end of the upflow passage. The difference in pressure generated in the lower end of the upflow passage causes the liquid refrigerant to be metered or aspirated into the upflow passage. A screen is provided for the inlet to the fluid flow tube to prevent impurities from entering the tube. One or more pressure equalization passages provide for pressure equalization between the storage vessel and the outlet to thereby prevent liquid refrigerant from flowing through the upflow passage and into the suction inlet of the compressor.

One advantage of the suction accumulator according to the present invention is that it is small in size yet accommodates a high refrigerant mass flow rate.

Another advantage of the invention is the provision of an improved liquid refrigerant metering structure.

A further advantage of the suction accumulator according to the present invention is that it is economical to construct since several of the accumulator parts may be molded or extruded from a plastic material. More particularly, the transition cap member, the support for the transition cap member, and the liquid metering tube may all be molded as a single unitary plastic member. Furthermore, the conduit may be an extruded plastic member.

A still further advantage of the suction accumulator according to the present invention is the provision of a very effective and simple pressure equalization structure.

The present invention, in one form thereof, comprises a suction accumulator including a storage vessel having a casing and a first end wall and forming a liquid storage volume and having an inlet for the vessel. A first conduit is disposed in the vessel, the conduit having first and second ends and including a divider for forming first and second fluid passageways in the conduit. The first fluid passageway is open to the vessel at the conduit first end. An outlet for the vessel is connected to the second fluid passageway at the conduit first end. A transition member is secured to the conduit second end and forms a third fluid passageway which interconnects the first fluid passageway and the second fluid passageway. A second conduit extends from the liquid storage volume into the second fluid passageway.

The present invention, in one form thereof, further provides a suction accumulator comprising a storage vessel including a casing and having first and second end walls and enclosing a fluid storage volume. A fluid inlet passage and a fluid outlet passage are provided in a first end of the vessel. A tubular conduit is disposed in the vessel and includes a divider plate to form upflow and downflow passages in the conduit. A first end of the upflow passage is connected to the fluid outlet passage and a first end of the downflow passage is open to the fluid storage volume. A transition cap member is secured to the end of the tubular conduit and defines a connecting passageway between the second ends of said upflow and downflow passageways whereby continuous fluid flow path is established from the fluid inlet passage through the downflow passageway, the connecting passageway, and the upflow passageway to the fluid outlet passage. A pressure equalizing passageway connects the fluid storage volume to the connecting passageway. A tubular conduit extends from the fluid storage volume through the transition cap member into the second end of the upflow passageway.

The present invention, in one form thereof, still further provides a suction accumulator comprising a tubular vessel including first and second end walls and enclosing a liquid storage volume. An inlet passage and an outlet passage are provided in a first end wall of the vessel. A conduit, having first and second ends and including first and second fluid flow passages therein, extends from the conduit first end in a first end of the vessel to the conduit second end in a second end of the vessel. A first end of the first fluid flow passage in the first end of the vessel is open. The outlet passage is connected to a first end of the second fluid flow passage for fluid flow communication therewith. A transition cap is secured to the conduit second end and forms a connecting fluid flow passage from the first fluid flow passage to the second fluid flow passage, whereby a continuous fluid flow path is established from the vessel inlet passage through the first fluid flow passage, the connecting passage, and the second fluid flow passage to the outlet passage. A spacer member is provided for spacing the transition cap from the second end wall and for defining a chamber. The spacer includes an aperture for establishing a fluid flow path between the chamber and the storage volume. A hollow conduit extends from the chamber through the transition cap and into the second end of the second fluid flow passage for conducting liquid refrigerant from the liquid storage volume into the second fluid flow passage. A screen is disposed in the chamber for preventing impurities from flowing from the liquid storage volume into the hollow conduit. An equalizer vent passage directly connects the first end of the liquid storage volume with the outlet passage.

It is an object of the present invention to provide a suction accumulator which is compact and which can accommodate a high refrigerant mass flow rate.

Another object of the invention is to provide a suction accumulator with an improved liquid refrigerant metering structure.

It is a further object of the present invention to provide an economical suction accumulator wherein a number of the parts of the suction accumulator assembly may be manufactured by molding or extrusion from a plastic material.

A yet further object of the present invention is to provide a very simple yet effective pressure equalization structure.

BRIEF DESCRIPTION OF THE DRAWINGS

The above mentioned and other features and objects of this invention, and the manner of attaining them, will become more apparent and the invention itself will be better understood by reference to the following description of an embodiment of the invention taken in conjunction with the accompanying drawings, wherein.

Corresponding reference characters represent corresponding parts throughout the several views of the drawings.

The exemplifications set out herein illustrate a preferred embodiment of the invention, in one form thereof, and such exemplifications are not to be construed as limiting the scope of the disclosure or the scope of the invention in any manner.

DESCRIPTION OF THE PREFERRED EMBODIMENT

Figure 1:
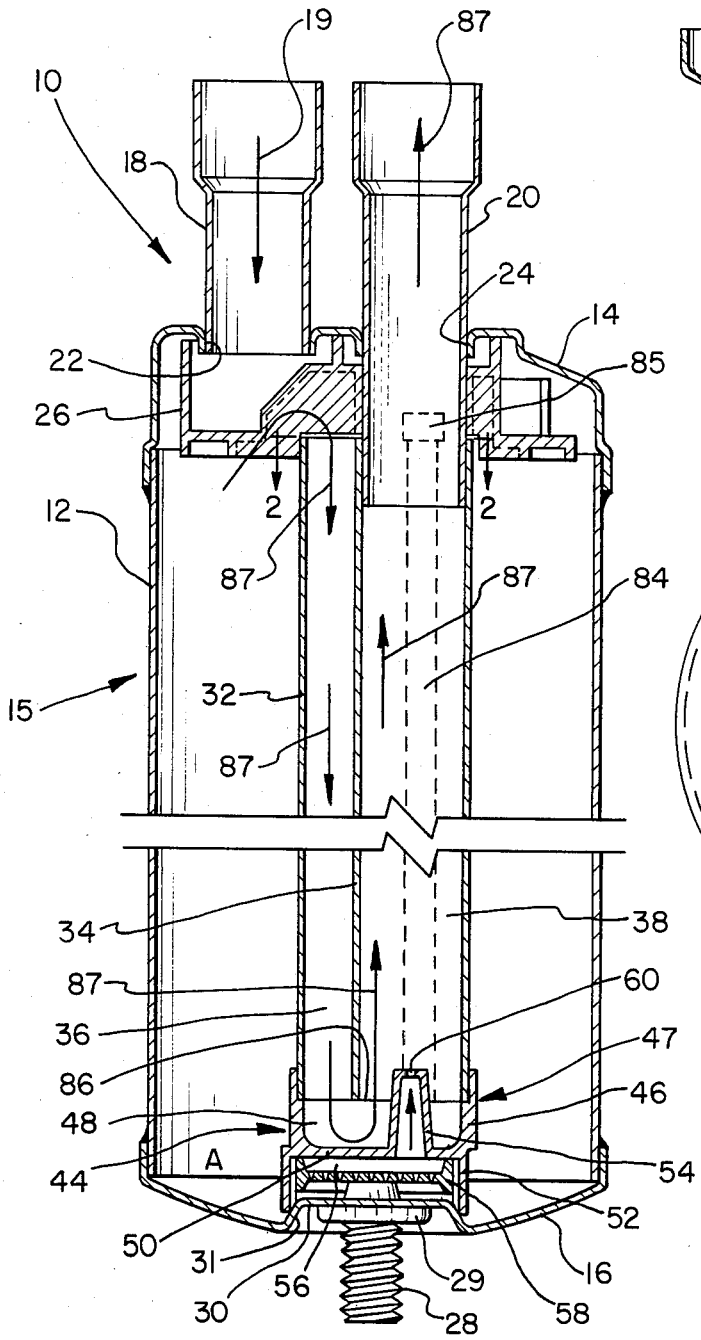
FIG. 1 is an elevational, sectional view of the suction accumulator according to the present invention.
Figure 9:
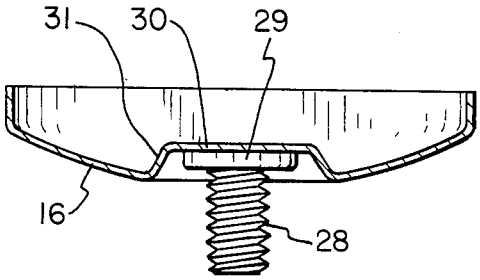
FIG. 9 is an elevational view of the bottom end cap.
Figure 8:
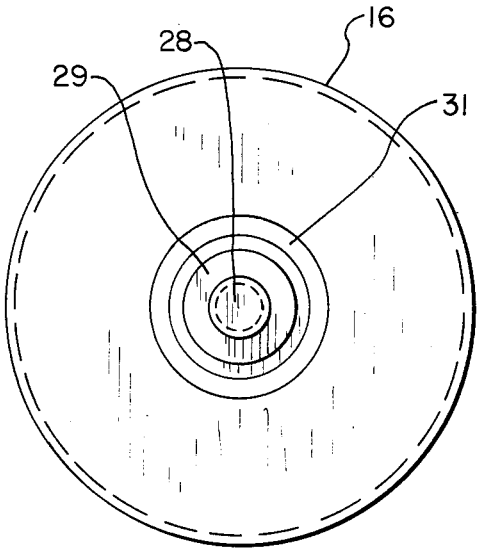
FIG. 8 is a bottom view of the suction accumulator of FIG. 1.

Referring to FIGS. 1, 8, and 9, a suction accumulator 10 is shown including a tubular casing or shell 12. The shell may be either cylindrical, as shown, or some other suitable shape. Shell 12 includes a top end wall 14 and a bottom end wall 16 to form a vessel 15 for storing liquid refrigerant. An inlet 18 and an outlet 20 for the vessel are also provided. Inlet 18 is in communication with an inlet opening 22 in top end wall 14. Outlet 20 is inserted through an outlet opening 24 in top end wall 14. Preferably the inlet and outlet each comprise copper or aluminum tubes which are secured to top end wall 14 by soldering, brazing or the like.

A baffle 26 is shown mounted in an upper portion of the vessel whereby refrigerant which enters inlet 18, as shown by means of the arrow 19 indicating the direction of flow, strikes baffle 26 and is deflected. By means of this arrangement, liquid refrigerant entering inlet 18 collects in the bottom of vessel 15 and gaseous refrigerant flows to outlet 20 by way of a flow path through accumulator 10 as further explained hereinbelow. The construction and method of operation of baffle 26 are further described in copending patent application, Ser. No. 842,493, filed on even date herewith and assigned to the same assignee as the present application, which disclosures is incorporated herein by reference.

Bottom end wall 16 is provided with a mounting stud 28 to mount the suction accumulator in a vertical position in a refrigeration system as is conventional. Mounting stud 28, is provided with a welding pad 29 for securing the mounting stud to a protruding portion 30 of end wall 16 which extends inwardly and upwardly into vessel 15. Protruding end wall portion 30 also includes a tapered portion 31 for purposes further explained hereinafter.

Figure 2:
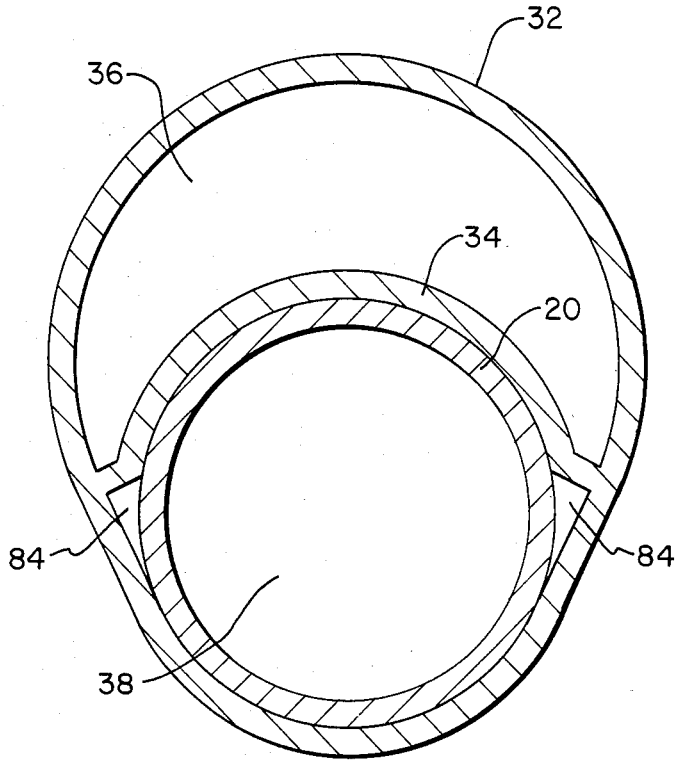
FIG. 2 is an enlarged sectional view of the refrigerant conduit taken along line 2—2 of FIG. 1.
Figure 4:
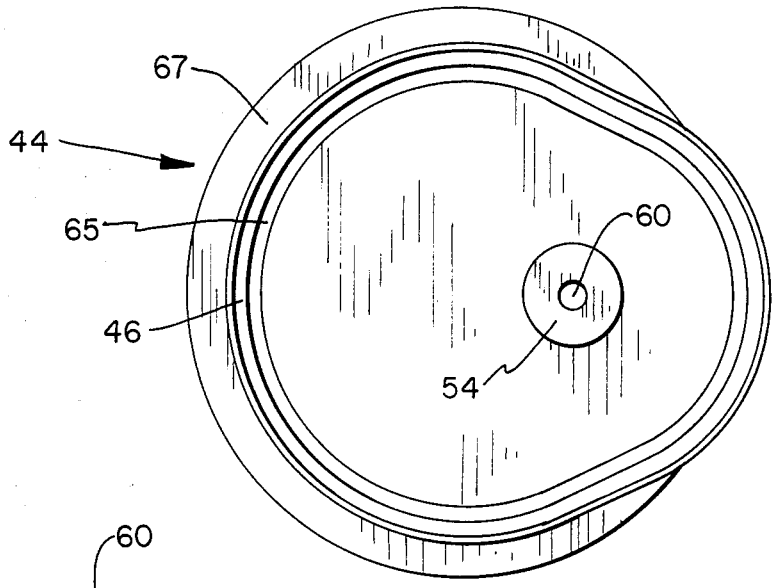
FIG. 4 is an enlarged top plan view of the transition cap member.
Figure 3:
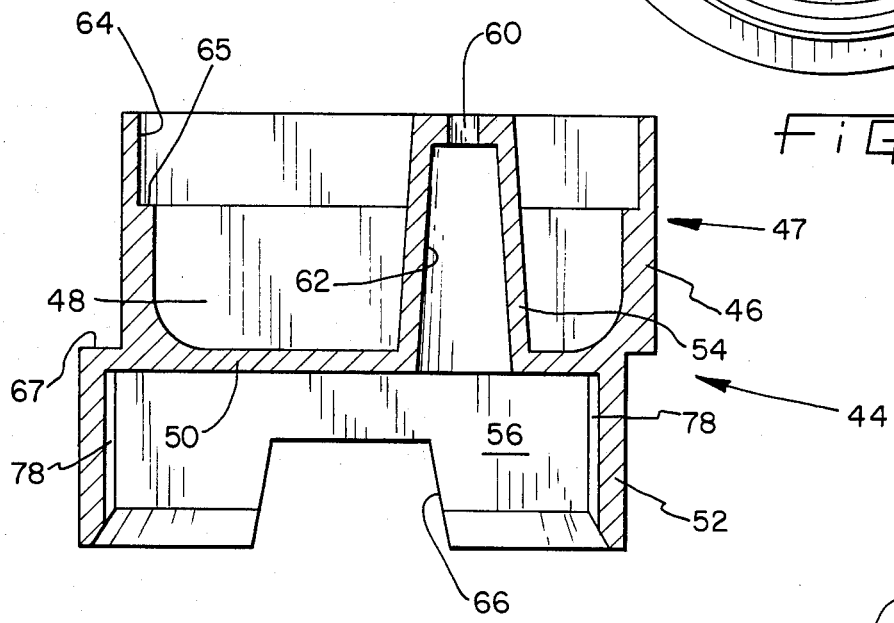
FIG. 3 is an enlarged sectional, elevational view of the transition cap member.
Figure 5:
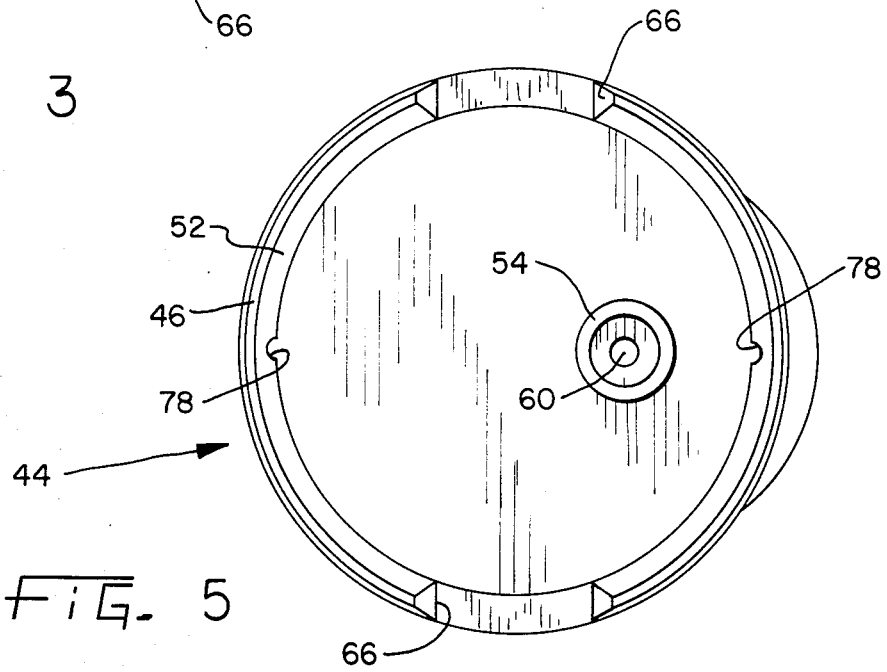
FIG. 5 is an enlarged bottom plan view of the transition cap member.
Figure 10:
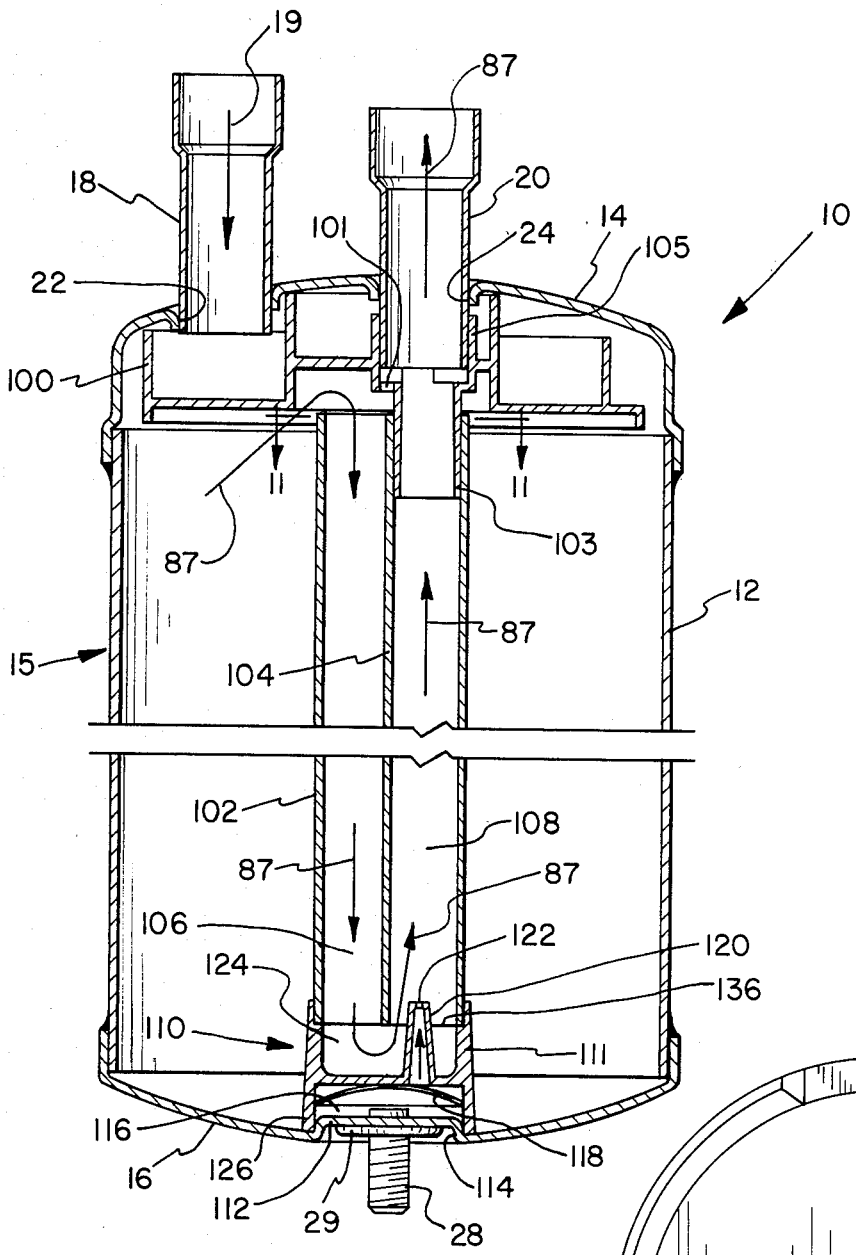
FIG 10 is an elevational, sectional view of another embodiment of the suction accumulator according to the present invention.
Figure 14:
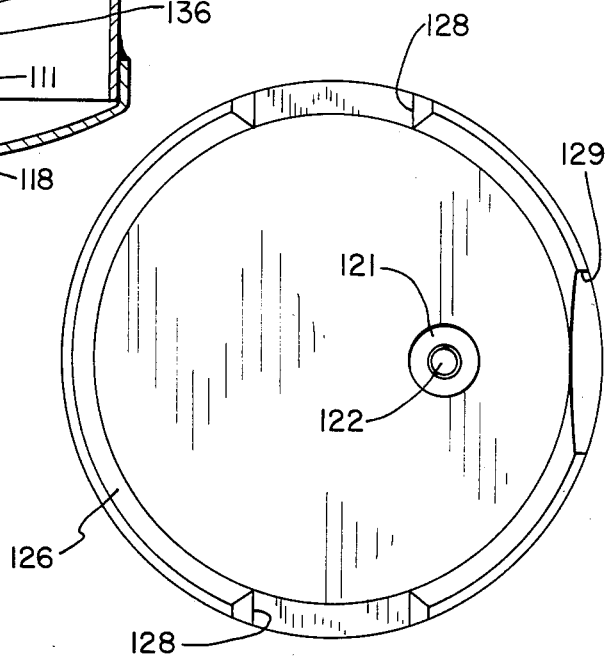
FIG. 14 is an enlarged bottom plan view of the transition cap member of FIG. 12.
Figure 11:
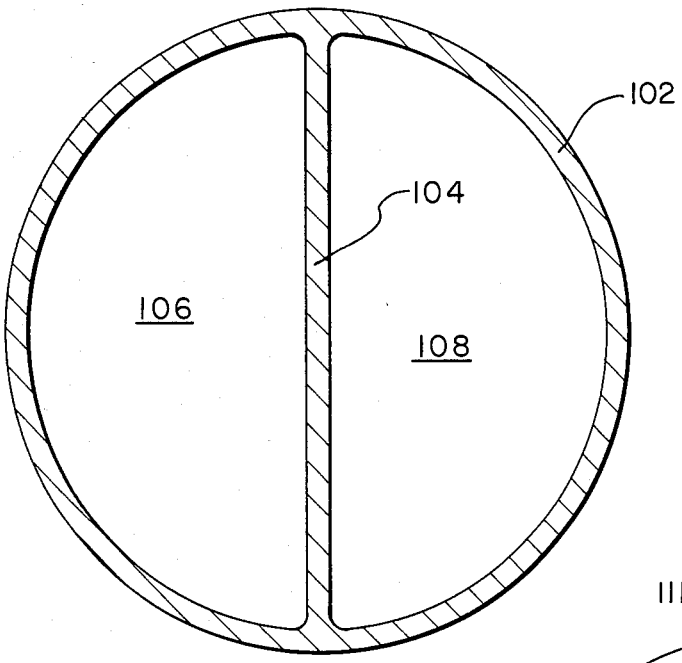
FIG. 11 is an enlarged sectional view of the refrigerant conduit of FIG. 10 taken along line 11—11.
Figure 13:
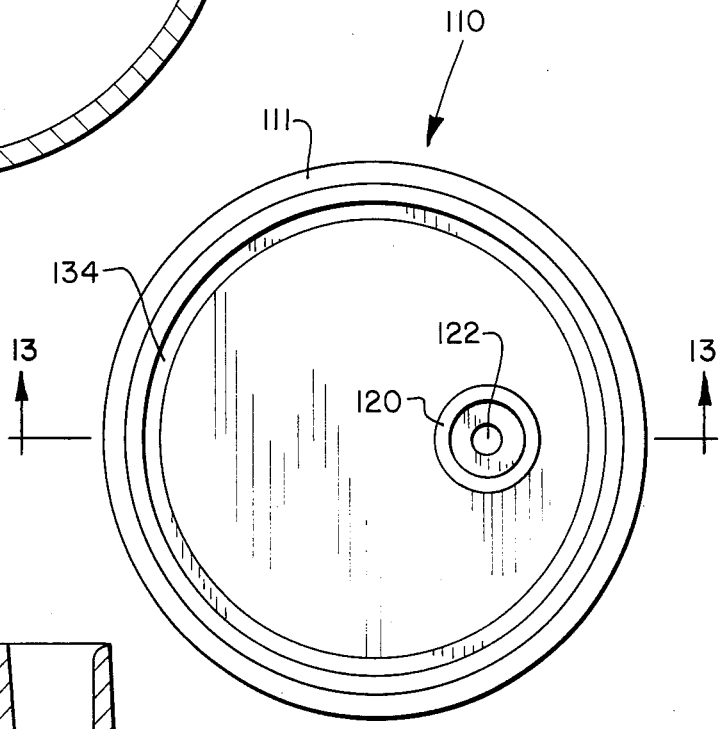
FIG. 13 is an enlarged top plan view of the transition cap member of FIG. 12.
Figure 12:
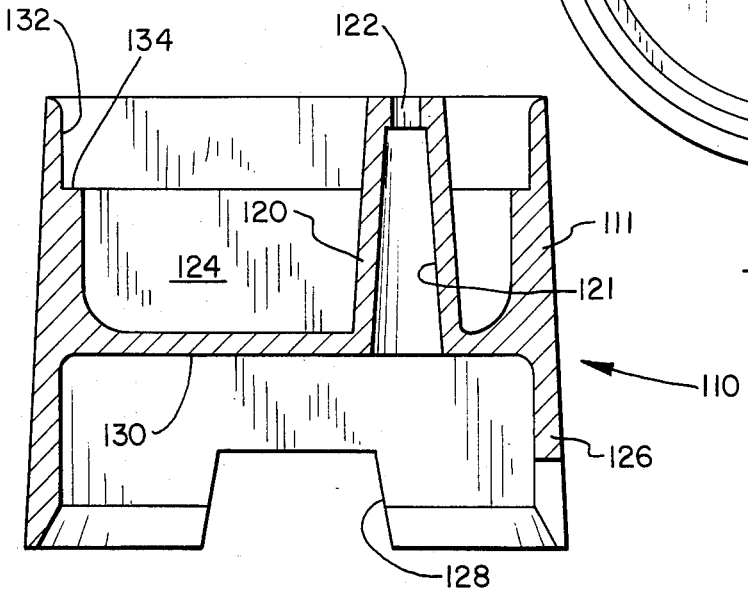
FIG. 12 is an enlarged sectional, elevational view of the transition cap member of FIG. 10.

As best seen in FIGS. 1, 2, and 3, conduit 32 is disposed inside vessel 15. The conduit includes a divider plate or weir 34 to form two fluid flow passages 36, and 38 in conduit 32. Thus, a downflow passage 36 and an upflow passage 38 are provided. Conduit 32 is preferably made of extruded plastic material such as ULTEM 1000 manufactured by the General Electric Co. of Mt. Vernon, Ind. A transition cap member 44 is sealingly secured to a lower end portion of conduit 32. Cap member may be sealed to conduit 32 by an interference fit, plastic welding, an adhesive, or the like. Transition cap 44 is shown in further detail in FIGS. 3, 4, and 5. Transition cap 44 includes an upstanding annular wall 46 and a bottom wall 50 to form a cup 47 including an enclosed cup volume 48. Transition cap 44 also includes a spacer portion 52 for spacing the cup 47 from bottom end wall 16 of vessel 15. As best seen in FIGS. 1 and 5, spacer 52 is cylindrical in configuration and engages with tapered portion 31 of bottom end wall 16. Thus, the upper end of conduit 32 is secured, such as by a press fit, with outlet 20 which, in turn, is soldered or brazed to upper end wall 14. At its lower end, conduit 32 rests on a shoulder 65 formed by a wall portion 64 of transition cap 44 and thereby forces transition cap 44 into contact with tapered portion 31 of the inwardly protruding portion 30 of bottom end wall 16. Thus, conduit 32 is secured against movement in vessel 15.

Referring now to FIGS. 1, and 3–5, a spacer 52 forms a chamber 56 with bottom wall 50 of transition cap 44 and with protruding portion 30 of bottom end wall 16. Cylindrical spacer 52 also includes a pair of apertures 66. Thus, chamber 56 communicates with the liquid storage volume of vessel 15 by means of apertures 66. A tubular conduit 54 extends upwardly from bottom portion 50 of transition cap 44. An orifice 60 is provided in the top portion of tubular conduit 54. The upper end of tubular conduit 54 extends into the upflow passage 38. Thus, liquid refrigerant may flow from the liquid storage volume of vessel 15, through aperture 66 and chamber 56, through tubular conduit 54 and orifice 60 into upflow passage 38. Transition cap 44 is preferably made by molding from a plastic material such as, for instance, ULTEM 2300 manufactured by General Electric Co. of Mt. Vernon, Ind. Cap 44, cup 47, spacer 52 and tubular conduit 54 may be integrally molded, thus reducing assembly costs.

Figure 6:
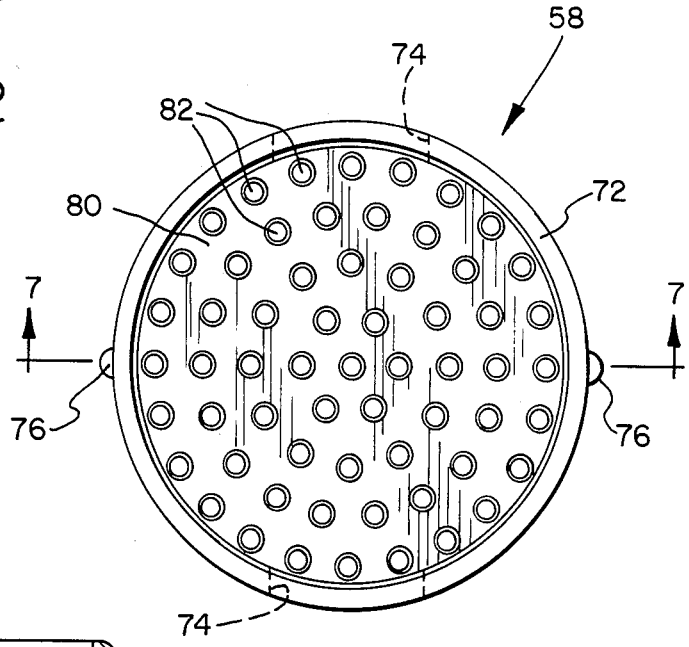
FIG. 6 is an enlarged top plan view of the screen member.
Figure 7:
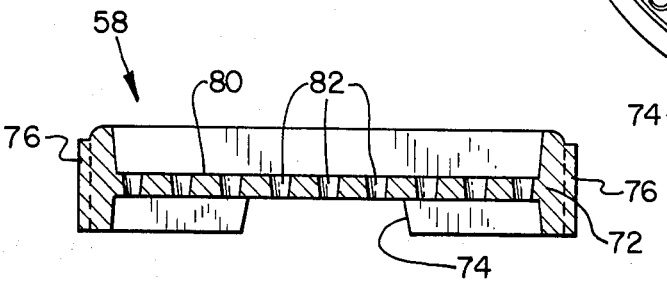
FIG. 7 is a sectional, elevational view of the screen member taken along line 7—7 of FIG. 6.

As best seen in FIGS. 1, 6, and 7, a screen member 58 including an annular wall portion 72 is located between apertures 66 and the inlet to tubular conduit 54. Annular member 72 includes apertures 74 which, in the assembled position of screen member 58, are aligned with apertures 66 in spacer 52. A pair of locating ribs 76 on annular wall 72 engage with locating guides 78 in spacer 52 to locate the screen and to align apertures 74 with apertures 66. Screen member 58 includes a screen 80 which has screen apertures 82 therein. Screen 80 prevents impurities which may be present in the liquid refrigerant in storage vessel 15 from entering tubular conduit 54 and thereby prevents impurities from reaching upflow conduit 38 and the suction inlet of the compressor. Screen member 58 is preferably made by molding from a plastic material such as, for instance, ULTEM 2300 manufactured by the General Electric Co. of Mt. Vernon, Ind.

By referring to FIGS. 1 and 2, it can also be seen that, by assembling inlet 20 to baffle 26 and conduit 32, a pair of pressure equalizing passages are formed. Ducts 84 are formed integrally with conduit 32 and are abaxial with respect to passages 36 and 38. The upper ends of ducts 84 are open to apertures 85 in baffle 26 and therefore to the upper end of vessel 15. The lower ends of ducts 84 are open to volume 48 of cup 47 and therefore to the upflow passage 38 of conduit 32. Therefore, when the compressor shuts off and system pressure equalization commences, if the liquid refrigerant level in vessel 15 is above the bottom end of conduit 32, it will quickly seal off passages 36 and 38 by filling cup 47 via the orifice 60. Without a pressure equalization passage such as provided by ducts 84, the sealing of passages 36 and 38 in conduit 32 would interrupt the pressure equalization and the pressure differentials would thereby force liquid refrigerant up passage 38 and into the compressor inlet, thus resulting in compressor "slugging" upon startup. Ducts 84 must open into the upper end of vessel 15 so that only gas passes through ducts 84 to allow pressure equalization to occur between the compressor and the refrigeration system. The liquid seal at the bottom of conduit 32 blocks off normal equalization paths, thus necessitating ducts 84 or some other pressure equalization system. Therefore, the use of ducts 84 permits refrigerant gas to flow from vessel 15 through apertures 85 and ducts 84, into the bottom inlet of conduit 38 and out of outlet 20.

In operation, refrigerant, including gaseous and entrained liquid refrigerant, flows through inlet 18 into vessel 15 and is separated by baffle 26 into its gaseous and liquid components. The liquid refrigerant will flow to the bottom of storage vessel 15. The gaseous refrigerant will flow, as indicated by the arrows 87, from the upper end of storage vessel 15 into downflow passage 36 and from there through a connecting passage formed by volume 48 of transition cap member 44 into upflow passage 38 and out of outlet 20. Since the gaseous refrigerant is caused to change directions from the downflow passage 36 to the upflow passage 38 and turns through 180°, turbulence is created at the inlet opening 86 of upflow passage 38. This fluid turbulence reduces the effective fluid flow cross sectional area of inlet opening 86 and thereby generates a reduced pressure zone in accordance with Bernoulli's principle. The effective fluid flow cross sectional area of opening 86 is in the range of 60% to 82% of the actual cross sectional area of opening 86. Furthermore, tubular conduit 54 which extends into opening 86, further reduces the effective cross sectional area of opening 86, thereby further reducing the pressure in the lower portion of upflow passage 38. A pressure drop is also experienced by the refrigerant which flows through downflow passage 36. Therefore, the pressure on the liquid refrigerant in storage vessel 15 will be higher than the pressure in opening 86 of upflow passage 38. By way of example, for a three inch diameter suction accumulator and at a high mass flow rate, there is a pressure drop of five inches of water column from point A as shown at the bottom portion of liquid storage vessel 15 to opening 86 of the upflow passage 38. At a low mass flow rate, this pressure drop will be approximately three inches of water column. Liquid refrigerant is thereby aspirated or drawn into upflow passage 38 by way of apertures 66, chamber 56, screen 80, tubular conduit 54, and orifice 60. The liquid refrigerant is metered by controlling the size of orifice 60. As the liquid refrigerant enters upflow passage 38, it will aspirate into a mist which blends with the refrigerant gas as it travels through the upflow passage 38 and into the suction side of the compressor.

When the compressor is turned off, the pressures in the refrigeration system will tend to equalize. Liquid refrigerant will therefore continue to flow through orifice 60 and will tend to fill up both upflow passage 38 and downflow passage 36. If liquid refrigerant were permitted to continue to flow upwardly, it would fill outlet 20 and cause severe slugging of the compressor upon startup. Ducts 84 are therefore provided in conduit 32 whereby the pressure in upflow passage 38 will equalize with the pressure in the upper portion of vessel 15, thus permitting flow of gaseous refrigerant through ducts 84 from the upper portion of vessel 15 to the outlet 20.

Referring now to FIGS. 10–14, there is disclosed another embodiment of the invention. Corresponding parts have been indicated by corresponding reference characters shown in FIGS. 1–9. The suction accumulator 10 includes a cylindrical or tubular casing 12, a top end wall 14 and a bottom end wall 16 defining a liquid storage vessel 15. An inlet 18 and an outlet 20 are shown. The accumulator may be mounted by means of a stud 28 which is secured to bottom end wall 16 by means of a welding pad 29.

A baffle 100 is shown mounted in the upper portion of vessel 15 and including an equalizer vent hole 101, a tubular conduit 103, and a cylindrical portion 105. Inlet 20 is secured in portion 105 as by a force fit. A cylindrical conduit 102 is provided including a generally planar divider wall 104 to divide conduit 102 into a downflow passage 106 and an upflow passage 108. Conduit 103 is shaped to fit snugly in upflow passage 108 and may be secured therein with an adhesive. Outlet 20 mates with a cylindrical portion 105 of baffle 100. Conduit 102 is preferably made of ULTEM 1000 manufactured by the General Electric Co. of Mt. Vernon, Ind.

A transition cap 110 is shown secured to a bottom portion of conduit 102 as with an adhesive. Transition cap 110 is preferably made from ULTEM 2300 manufactured by General Electric Co. of Mt. Vernon, Ind. Transition cap 110 includes an upstanding wall member 111 and a bottom wall 130 to define a cup-like transition chamber 124. Bottom end wall 16 includes a protruding wall portion 112 having a generally cylindrical upstanding wall portion 114. A transition cap member 110 includes a spacer portion 126 which fits over protruding wall portion 112 for defining a chamber 116 when transition cap member is assembled to bottom end wall 16. A screen 118, which may be made of metal, is disposed in chamber 116. Transition cap member 110 includes a pair of apertures 128 and an additional aperture 129. Liquid refrigerant may thus flow through apertures 128 and 129 into chamber 116 and through screen 118, a tubular conduit 120, and an orifice 121 into the lower end of upflow conduit 108, in similar fashion as explained hereinabove in connection with the embodiment of FIGS. 1–9.

In operation, refrigerant, including gaseous and entrained liquid refrigerant, flows through inlet 18 into vessel 15 and is separated by baffle 100 into its gaseous and liquid components. The liquid refrigerant will flow to the bottom of storage vessel 15. The gaseous refrigerant will flow, as indicated by arrows 87, from the upper end of storage vessel 15 into downflow passage 106 and from there through a connecting passage formed by transition cup volume 124 into upflow passage 108 and out of outlet 20. As the gaseous refrigerant is caused to change directions from the downflow passage 106 to the upflow passage 108 and turns through 180°, turbulence is created at the inlet opening 136 of upflow passage 108. This fluid turbulence reduces the effective fluid flow cross sectional area of inlet opening 86, as explained hereinabove, and thereby generates a reduced pressure zone in accordance with Bernoulli's Principle. Furthermore, tubular conduit 120 which extends into opening 136, further reduces the effective cross sectional area of opening 136, thereby further reducing the pressure in the lower portion of upflow passage 108. Thus, the combined pressure drop experienced by refrigerant flowing through downflow conduit 106 and through opening 136 will cause a pressure differential to exist between the liquid refrigerant stored in storage vessel 15 and opening 136 of upflow passage 108. Liquid refrigerant is therefore aspirated or drawn into upflow passage 108 by way of apertures 128 and 129, chamber 116, screen 118, tubular conduit 120, and orifice 122. The liquid refrigerant is metered by controlling the size of orifice 122. As liquid refrigerant enters upflow passage 108, it will aspirate into a mist which blends with the refrigerant gas as it travels through the upflow passage 108 and into the suction side of the compressor.

When the compressor is turned off, the pressures in the refrigeration system will tend to equalize. Liquid refrigerant will therefore continue to flow through orifice 122 and will tend to fill up both the upflow conduit 108 and the downflow conduit 106. Vent passage 101 is provided in baffle 100 to equalize the pressures in the upper portion of vessel 15 through vent 101 by permitting direct flow from the upper portion of vessel 15 to outlet 20, thereby preventing liquid refrigerant from filling upflow conduit 108 and preventing "slugging" of the compressor upon start up.

What has therefore been provided is an efficient, compact suction accumulator which is relatively inexpensive to manufacture and which includes molded and extruded plastic components.

While this invention has been described as having a preferred design, it will be understood that it is capable of further modification. This application is therefore intended to cover any variations, uses, or adaptations of the invention following the general principles thereof and including such departures from the present disclosure as come within known or customary practice in the art to which this invention pertains and fall within the limits of the appended claims.

What is claimed is:

1. A suction accumulator comprising:

a storage vessel including a casing having a first end wall and defining a liquid storage volume;

an inlet for said vessel;

a first conduit disposed in said vessel, said conduit having first and second ends, said conduit including a divider means for forming first and second fluid passageways in said conduit, said first fluid passageway being open to said vessel at said conduit first end;

an outlet for said vessel connected to said second fluid passageway at said conduit first end;

a transition member secured to said conduit second end and forming a third fluid passageway, said third fluid passageway interconnecting said first fluid passageway and said second fluid passageway; and a second conduit extending from said liquid storage volume into said second fluid passageway.

2. The suction accumulator of claim 1 wherein said transition member includes a spacer means for spacing said transition member from said first end wall.

3. The suction accumulator of claim 2 wherein said transition member, said second conduit, and said spacer means, comprise a unitary member.

4. The suction accumulator of claim 3 wherein said unitary member comprises a molded plastic member.

5. The suction accumulator of claim 2 wherein said end wall includes an inwardly protruding tapered portion for locating said spacer means.

6. The suction accumulator of claim 2 wherein said spacer means comprises an annulus, said annulus forming a chamber with said first end wall and said transition member, said annulus including apertures therein for fluid flow communication of said liquid storage volume with said chamber.

7. The suction accumulator of claim 2 including a screen in said spacer means between said liquid storage volume and the inlet to said second conduit.

8. The apparatus of claim 1 including a tubular support member for supporting said transition member on said end wall, said tubular support member including apertures therein for fluid flow communication of said liquid storage volume with the volume enclosed in said tubular support member; and a screen supported in said tubular support member and located in the flow path between said support member apertures and the inlet of said second conduit.

9. The apparatus of claim 8 wherein said screen includes a locating means for locating said screen in said tubular support means.

10. The suction accumulator of claim 1 wherein said first conduit includes a pressure equalizing means for equalizing the pressures between said second fluid passageway and said liquid storage volume.

11. The suction accumulator of claim 1 wherein the effective cross-sectional area of the open end of said second fluid passageway at said conduit second end comprises a fraction in the range of 60% to 82% of the actual cross-sectional area of said open end.

12. A suction accumulator comprising:

a storage vessel including a casing having first and second end walls and enclosing a fluid storage volume;

a fluid inlet passage and a fluid outlet passage connected to a first end of said vessel;

a tubular conduit disposed in said vessel;

a divider plate in said tubular conduit for forming upflow and downflow passageways in said conduit, a first end of said upflow passage connected to said fluid outlet passage, and a first end of said downflow passage being open to said fluid storage volume;

a transition cap member secured to the end of said tubular conduit and defining a connecting passageway between the second ends of said upflow and downflow passageways whereby a continuous fluid flow path is established from said fluid inlet passage through said downflow, connecting, and upflow passageways to said fluid outlet passage;

a pressure equalizing passageway connecting said fluid storage volume to said fluid outlet passage; and a tubular conduit extending from said fluid storage volume through said transition cap member into the second end of said upflow passageway.

13. The suction accumulator of claim 12 wherein said transition cap member includes a spacer means for spacing said transition cap member from said second end wall.

14. The suction accumulator of claim 13 wherein said spacer means comprises an annulus, said annulus forming a chamber with said second end wall and a bottom wall of said transition member, said annulus including apertures therein for establishing a fluid flow path from said fluid storage volume to said chamber.

15. The suction accumulator of claim 13 including a screen means disposed in said spacer means.

16. The suction accumulator of claim 13 wherein said transition member, said tubular conduit, and said spacer means comprise a unitary plastic member.

17. The suction accumulator of claim 13 wherein said second end wall includes an inwardly protruding tapered portion for locating said spacer means.

18. The apparatus of claim 12 including a tubular support member for supporting said transition member on said housing second end wall, the wall of said tubular support member including apertures therein, a screen supported in said tubular support member and located in the flow path between said apertures and said second conduit.

19. The apparatus of claim 18 wherein said screen includes locating means for locating said screen in said tubular support means.

20. The suction accumulator of claim 12 wherein the effective cross-sectional area of the open second end of said upflow passageway comprises a fraction of the actual cross-sectional area of said open second end in the range of 60% to 82%.

21. A suction accumulator comprising:

a tubular storage vessel including first and second end walls and enclosing a liquid and gas storage volume;

an inlet passage and an outlet passage in a first endwall of said vessel;

a conduit having first and second ends and including first and second fluid flow passages therein extending from said conduit first end in a first end of said vessel to said conduit second end in a second end of said vessel, a first end of said first fluid flow passage in said first end of said vessel being open to said liquid storage volume;

said outlet passage connected to a first end of said second fluid flow passage for fluid flow communication therewith;

a transition cap secured to said conduit second end and forming a connecting fluid flow passage from said first fluid flow passage to said second fluid flow passage, whereby a continuous fluid flow path is established from said vessel inlet passage through said first fluid flow passage, said connecting passage, and said second fluid flow passage to said outlet passage;

a spacer member for spacing said transition cap from said second end wall and forming a chamber, said spacer including an aperture for establishing a fluid flow path between said chamber and said storage volume;

a hollow conduit extending from said chamber through said transition cap and into a second end of said second fluid flow passage for conducting liquid refrigerant from said storage volume into said second fluid flow passage;

a screen disposed in said chamber for preventing impurities from flowing from said liquid storage volume into said hollow conduit; and an equalizer vent passage directly connecting the first end of said liquid storage volume to said outlet passage.

22. The suction accumulator of claim 21 wherein said screen includes locating means for locating said screen in said spacer member.

23. The suction accumulator of claim 22 wherein the effective cross-sectional area of the open second end of said second fluid passage comprises a fraction in the range of 60% to 82% of the actual cross-sectional area of said open second end.

24. The suction accumulator of claim 21 wherein said transition cap, said hollow conduit, and said spacer member comprise a unitary molded plastic member.

25. The suction accumulator of claim 21 wherein said second end wall includes an inwardly protruding tapered portion for locating said supporting member.

26. The suction accumulator of claim 21 wherein said equalizer vent passage comprises at least one elongated conduit abaxially arranged with said first and second fluid flow passages.

* * * * *